US006739346B2

(12) United States Patent
Cotte et al.

(10) Patent No.: US 6,739,346 B2
(45) Date of Patent: May 25, 2004

(54) APPARATUS FOR CLEANING FILTERS

(75) Inventors: John Michael Cotte, New Fairfield, CT (US); Kenneth John McCullough, Fishkill, NY (US); Wayne Martin Moreau, Wappinger, NY (US); Keith R. Pope, Danbury, CT (US); John P. Simons, Wappingers Falls, NY (US); Charles J. Taft, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/207,509

(22) Filed: Jul. 29, 2002

(65) Prior Publication Data

US 2003/0000556 A1 Jan. 2, 2003

Related U.S. Application Data

(62) Division of application No. 09/893,208, filed on Jun. 27, 2001, now Pat. No. 6,457,480.

(51) Int. Cl.[7] ..... B08B 3/10

(52) U.S. Cl. ..... 134/105; 134/107; 134/152; 134/200

(58) Field of Search ..... 134/105, 107, 134/200, 152

(56) References Cited

U.S. PATENT DOCUMENTS

| | | | | |
|---|---|---|---|---|
| 2,194,607 | A | * | 3/1940 | McDevitt |
| 3,608,567 | A | * | 9/1971 | Neil, Jr. |
| 3,765,051 | A | * | 10/1973 | Wanat |
| 5,034,066 | A | * | 7/1991 | Imhof et al. |
| 5,355,901 | A | * | 10/1994 | Mielnik et al. |
| 5,482,627 | A | * | 1/1996 | Pierson |
| 5,526,834 | A | * | 6/1996 | Mielnik et al. |
| 6,355,072 | B1 | * | 3/2002 | Racette et al. |
| 6,558,432 | B2 | * | 5/2003 | Schulte et al. |
| 6,589,592 | B1 | * | 7/2003 | Worm et al. |
| 6,596,175 | B2 | * | 7/2003 | Rowe |
| 6,610,251 | B1 | * | 8/2003 | Kanno |

* cited by examiner

*Primary Examiner*—Frankie L. Stinson
(74) *Attorney, Agent, or Firm*—Scully, Scott Murphy & Presser; Daniel P. Morris

(57) ABSTRACT

A process and apparatus for cleaning filters prior to recycling or disposal. In this process and apparatus liquid or supercritical carbon dioxide contacts the plugged pores of a filter under conditions in which carbon dioxide remains in the liquid or supercritical state.

4 Claims, 3 Drawing Sheets

APPARATUS FOR CLEANING FILTERS

CROSS-REFERENCE TO RELATED APPLICATION

This is a divisional of U.S. patent application Ser. No. 09/893,208, filed Jun. 27, 2001, now U.S. Pat. No. 6,457,480.

BACKGROUND OF THE DISCLOSURE

1. Field of the Invention

The present invention is directed to a process and apparatus for cleaning filters. More specifically, the present invention is directed to a process and apparatus for cleaning filters by contacting the filters to be recycled or disposed of with liquid or supercritical carbon dioxide.

2. Background of the Prior Art

At present when a filter, for whatever purpose, is no longer effective because its pores are filled with the material to be filtered from a fluid stream, such filters are "thrown away." This practice leads to environmentally unfriendly results. It is not always known what agents contaminate the used filters. Such agents are oftentimes harmful to the environment even if the used filter is buried or combusted.

Not only does the present practice of disposing of used filters present an environmental problem but the replacement of many of these filters represent a high economic cost. Indeed, certain filters are very expensive and thus their replacement exacts a high economic price.

To elaborate this latter point, filters formed of polyfluoroethylene and other expensive polymeric materials employed in processing steps involved in the formation of semiconductors, food products and the like can each cost as much as $1,000 or even more.

The cost involved in discarding plugged filters, furthermore, results in the discarding of a filter core. The filter core merely serves to support the filter element and facilitate drainage rather than removing particulates, which, or course, is the function of the filter. Thus, even if the filter cannot be cleaned and recycled, it is apparent that the disposal of filter cores represents an unnecessary economic and environmental waste.

In recognization of the economic and environmental savings to be obtained by retention of filter cores, attempts have been made to design filter apparatus in which only the filter element is replaced. The purpose of such designs is to retain cores so as to eliminate the environmental and economic losses associated with their replacement. In such designs, the replaceable filter element is slipped onto a support core and clamped to the core with rings or other compression-based appliances. Unfortunately, the application of such appliances to a filter element compresses the filter medium and results in disruption of uniform filtering characteristics and flow. As a result, structural integrity and filtration performance of the filter element may be impaired. Furthermore, unless the replacement of the filter element is done carefully, the filter element can be damaged. As such, a design which permits separation of the core and the filter element, to overcome the environmental and economic costs associated with filter replacement, is not totally availing.

Another problem associated with conventional reusable core type filter assemblies is the absence of any valve-type structures for pressure relief, temperature sensitive flow control and filter by-pass. Rather, filter assemblies provided with valve-type structures, essential in continuous fluid flow applications where circulation is paramount, are limited to unitary filter assemblies where the core is not reusable.

Among filters which meet the parameters discussed above, i.e. high cost filters having very small pore size, are filters employed in photoresist and other semiconductor processing. U.S. Pat. Nos. 5,554,414; 5,698,281; 5,885,446 and 6,000,558 all describe filters which are useful in these applications. Such filters are formed of woven nylon, polypropylene and polytetrafluoroethylene membranes or film cartridges. Presently, such filters are disposed of when they become plugged.

The reason for the inability, in the prior art, to overcome these problems by cleaning filters is that fluids usually employed in cleaning such polymeric surfaces are aqueous or organic solvents having physical properties which cannot penetrate very small pores. As indicated in standard texts, such as Adamson, "Physical Chemistry of Surfaces," Chapters 1 and 7, J. Wiley (1976), an effective cleaning fluid must wet the surface and have a low contact angle. The surfaces of polymeric surfaces employed in filters, such as the surface of polytetrafluoroethylene, often have low surface energies, i.e. in the range of about 10 to 20 dynes/cm. However, water and acetone, typical solvents used in such operations, have surface energies of about 80 dynes/cm and 30 dynes/cm, respectively. As such, these typical cleaning solvents do not wet such polymeric surfaces. Therefore, high back pressure is required to backwash a clogged filter to overcome the viscous drag forces of backwashing.

In addition to the problems associated with the high surface energy of fluids typically employed in cleaning debris from filters, an additional factor that discourages their use is the requirement that a still further drying step is required, subsequent to any successful utilization of such fluids in cleaning filters, given the fact that the aqueous or organic fluid employed in cleaning filters is not completely removed in the filter cleaning operation.

The above remarks establish the need in the art for an effective cleaning method to remove contaminants from filters having very small pore sizes.

BRIEF SUMMARY OF THE INVENTION

A new process has now been developed which permits the cleaning of filters of all types including those which having nanometer-sized pores. This new process is effective insofar as it permits the cleaning fluid to wet the polymer filter surface. The effectiveness of this new process is due to the novel physical properties of the cleaning fluid.

In accordance with the present invention a process of cleaning filters whose pores are fouled with particulates is provided. In this process a particulate-fouled filter medium is contacted with liquid or supercritical carbon dioxide composition. In further accordance with the present invention an apparatus for cleaning filters is provided. The apparatus of the present invention includes means of contacting a particulate-fouled filter medium with a liquid or a supercritical carbon dioxide composition.

BRIEF DESCRIPTION OF THE DRAWINGS

The present invention may be better understood by reference to the accompanying drawings of which.

DETAILED DESCRIPTION

Figure 1A:
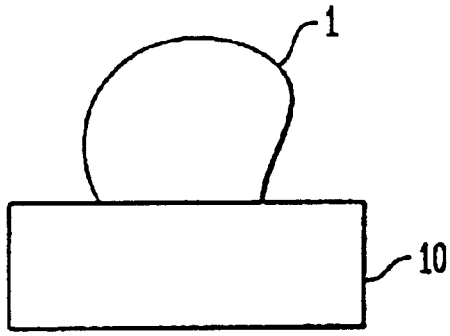
FIGS. 1A, 1B and 1C are depictions of contact angles of various cleaning fluids on a polytetrafluoroethylene surface.
Figure 1B:
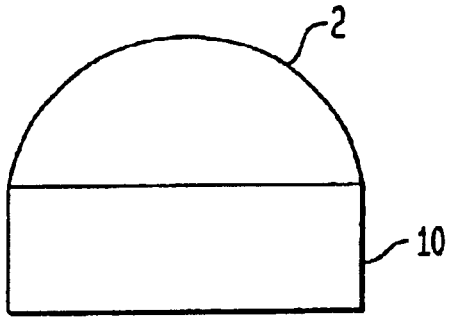
Figure 1C:
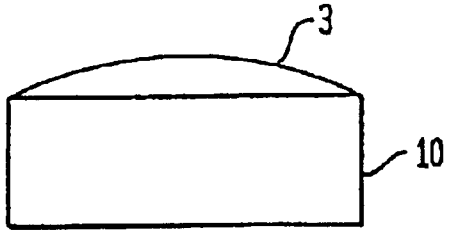

The fundamental problem associated with cleaning of filter media having small pore size is the contact angle of commonly employed cleaning fluids compared to the contact angle of materials commonly utilized as filter media. FIG. 1A provides a depiction of the contact angle of the most common cleaning fluid, water. A droplet of water, depicted by reference numeral 1, is shown disposed on a polytetrafluoroethylene surface 10. It is noted that the angle of contact is relatively small. FIG. 1B illustrates the deposition of a droplet of another commonly employed cleaning fluid of the prior art, acetone, on the same polytetraflurorethylene surface 10. As shown in FIG. 1B, the contact angle of a droplet 2 of acetone is greater than water and thus, although not large enough to completely wet the surface 10, provides better wetting than water. Finally, FIG. 1C depicts the disposition, upon an identical polytetrafluoroethylene surface 10, of a droplet 3 of liquid or supercritical carbon dioxide. The contact angle of the liquid or supercritical carbon dioxide droplet 3 is far greater than acetone and thus provides good wetting of the polymeric surface 10.

Figure 2A:
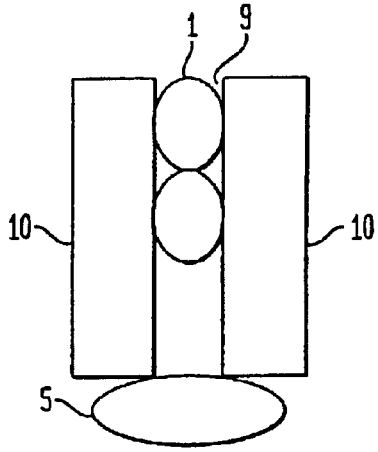
FIGS. 2A, 2B and 2C are depictions of backwashes of a clogged polytetrafluoroethylene-type filter with the three fluids depicted in FIGS. 1A, 1B and 1C.

The consequences of the different contact angles of various fluids on polymeric surfaces, in terms of removing particles embedded in filter pores, is illustrated in FIG. 2. In FIG. 2 a polymer, again denoted by reference 10, defines a pore 9 into which water 1 is introduced to remove debris particles 5 embedded therein. As shown in FIG. 2A, the pore contact angle of water 1 on polymeric surface 10 prevents the water from substantially wetting the surface 10 and thus penetrating the pore 9 to put back pressure on the debris particle 5.

Figure 2B:
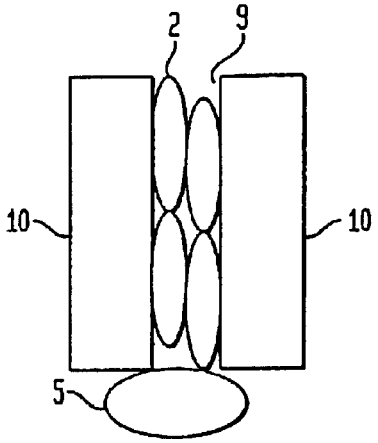

A similar effect is noted when droplets 2 of acetone are employed in this endeavor. Although droplets 2 of acetone provide better wetting of the surface of polymer 10 than droplets 1 of water, the degree of wetting is inadequate to penetrate the pore 9 to completely dislodge debris particle 5. This effect is depicted in FIG. 2B.

Figure 2C:
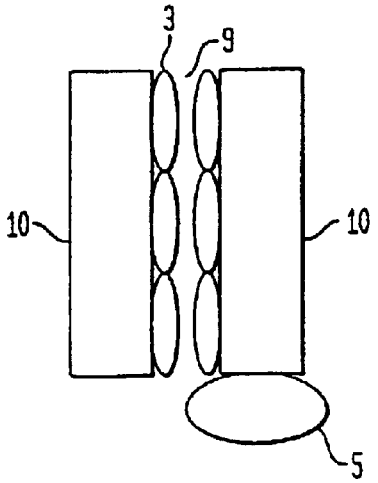

Finally, FIG. 2C illustrates utilization of liquid carbon dioxide or supercritical fluid carbon dioxide wherein droplets 3 of liquid or supercritical carbon dioxide, which has a very low contact angle with polymeric surface 10, produces excellent wetting of the surface of the polymer 10 permitting the fluid 3 to completely penetrate pore 9 to dislodge the debris particle 5.

The above analysis, which explains the effectiveness of the process of the present invention, is utilized in the apparatus of the present invention. A source of liquid carbon dioxide or supercritical carbon dioxide 12 supplied from a pumping system (not shown), is introduced into a conduit 15. Conduit 15 branches into two conduits 17 and 19 in which valves 20 and 30, respectively, are disposed. In accordance with the process of the present invention, valves 20 and 30 are simultaneously opened to equalize the pressure in a process chamber 40. Upon pressure equalization, valve 20 is closed. Thus, supercritical or liquid carbon dioxide flows through conduit 19 into chamber 40 wherein a filter 60 is disposed. The liquid or supercritical carbon dioxide exits chamber 40 through conduit 21. Carbon dioxide fluid flow in conduit 21 is controlled by valve 50. The carbon dioxide fluid is depressurized downstream of valve 50 and contaminants and other constituents entrained in the carbon dioxide fluid are separated therefrom by methods well known in the art.

Figure 3:
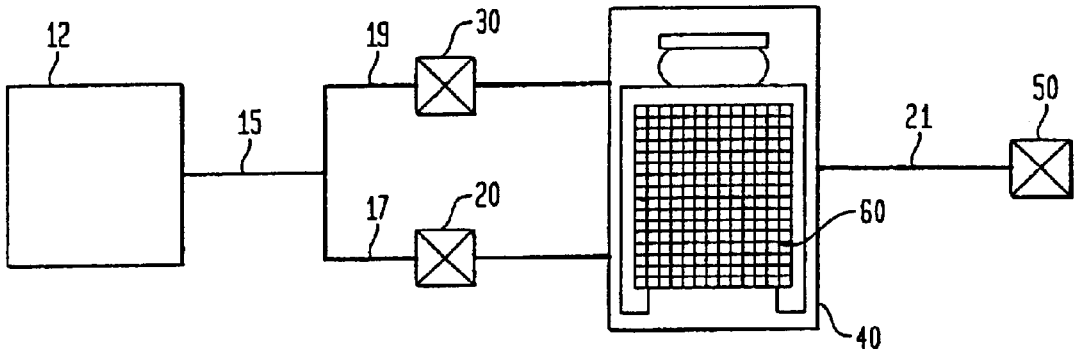
FIG. 3 is a schematic flow diagram of a filter cleaning apparatus in accordance with the present invention.

It is noted that filter 60, depicted in FIG. 3, is typically a cartridge type filter. However, other filter types, such as a disc-type filter, may equally be accommodated in the apparatus of the present invention. This is so in that any filter 60 that can be mounted in process chamber 40, such that the top and bottom of the filter 60 is sealed against the top and bottom of the process chamber 40, may be employed to effectuate the process described above.

It is furthermore emphasized that the process and apparatus described above involves carbon dioxide fluid flow into filter 60 reverse from the flow of fluids which are subject to filtration by the filter 60.

Although the above discussion refers to flow of liquid or supercritical carbon dioxide, it should be appreciated that the liquid or supercritical carbon dioxide may, in a preferred embodiment, be provided as a composition. In one such preferred embodiment the composition includes a surfactant. In this preferred embodiment the composition comprises a surfactant in a concentration in the range of between about 0.01% and about 50% by weight, based on the total weight of the composition. More preferably, the surfactant concentration is in the range of between about 0.1% and about 25% by weight. Still more preferably, the concentration of surfactant is in the range of between about 0.1% and about 5%. Yet still more preferably, the surfactant constituent is present in an amount of between about 0.1% and about 1%. Most preferably, the surfactant constituent represents between about 0.1% and about 0.5% by weight. It is emphasized that all of the aforementioned concentrations are based on the total weight of the composition.

Surfactants within the contemplation of the present invention include polyethers, siloxanes, fluoroalkanes, reaction products thereof and mixtures thereof. Although many polyether, siloxane and fluoroalkanes surfactants well known in the art are useful in the present invention, certain of these surfactants are particularly preferred for utilization in the process and apparatus of the present invention. For example, amongst polyether surfactants, polyalkylene oxides are preferred. Thus, polyethers as polyethylene oxide (PEO), polypropylene oxide (PPO) and polybutylene oxide (PBO) are particularly preferred. Block copolymers of these polyalkylene oxides, such as (PEO-b-PPO-b-PBO) and (PEO-b-PPO-b-PBO), i.e. Pluronic® and Tetronic® triblock copolymers, and (PPO-b-PEO) are particularly preferred. Another polyether surfactant particularly useful in the present invention combines a polyether with a fluorine-containing polymer. That surfactant is perfluoropolyether ammonium carboxylate.

Among fluorine-containing surfactants, several fluoroalkanes are preferred for employment as a surfactant of the present invention. Among the fluoroalkane surfactants such species as 4-(perfluoro-2-isopropyl-1,3-dimethyl-1-butenyloxy)benzoic acid (PFBA) and 4-(perfluoro-2-ispropyl-1,3-dimethyl-1-butenyloxy)benzene sulfonic acid (PFBS) find particular application as the surfactant in the composition of the present invention. Among siloxanes preferred for utilization as the surfactant of the composition of the present invention, preference is given to such species as poly(dimethylsiloxane) copolymers (PDMS). As indicated above, combinations of preferred surfactants, such as the combination of the polysiloxane and a polyether, e.g. the graft copolymer (PDMS-g-PEO-PPO), is particularly desirable.

Liquid or supercritical carbon dioxide compositions preferred for use in the process and apparatus of the present invention may include a co-solvent. If present, the co-solvent is included in a concentration in the range of between about 1% and about 25% by volume, based on the total volume of the co-solvent and carbon dioxide component. More preferably, the concentration of the co-solvent is in the range of between about 5% and about 10% by volume, based on the total volume of the co-solvent and carbon dioxide components. Most preferably, the co-solvent is present in a concentration of between about 6% and about 8% by volume, based on the total volume as the solvent and carbon dioxide component.

In the preferred embodiment wherein a co-solvent is employed in the composition, the co-solvent is preferably a diacid having the structural formula HOOC—$(CH_2)_n$—COOH, where n is 0, 1 or 2; a sulfonic acid having the structural formula $RSO_3H$, where R is hydrogen, methyl, ethyl or $CF_3$; a carboxylic acid having the structural formula $R^1COOH$, where $R^1$ is hydrogen, $CF_3$, $C_2F_5$, methyl, ethyl or propyl; triethanolamine; an alcohol having the structural formula $R^2OH$, where $R^2$ is methyl, ethyl or isopropyl; methylethyl ketone; acetone; N-methyl pyrollidone; gamma-butyrolactone; dimethyl sulfoxide; tetrahydrofuran; and mixtures thereof.

In another preferred embodiment the composition includes both a surfactant and a co-solvent wherein surfactants and co-solvents defined above are utilized in concentrations within the ranges recited above.

In another preferred embodiment of the present invention a liquid or supercritical carbon dioxide composition is provided which includes, in addition to the carbon dioxide constituent and a surfactant, an oxygen-containing compound selected from the group consisting of a ketal, an acetal or an ether along with a lesser amount of an acid. In this embodiment the combined concentration of the oxygen-containing compound and acid is about 1% to about 5% by weight, based on the total weight of the composition. Furthermore, the molar ratio of the oxygen-containing compound to acid is in the range of between about 1:1 and about 10:1. More preferably, the molar ratio of ketal, acetal or ether to acid is in the molar ratio of between about 1:1 and about 5:1.

Preferred examples of oxygen-containing compounds useful in the present invention include dimethylacetyl, acetone dimethylacetyl, acrolein dimethylacetyl, 3-methoxypropanolaldehyde dimethylacetyl, 2-methoxypropene and 1-methoxycyclohexene. Preferred acids utilized in this preferred embodiment of the composition employed in the present invention include carboxylic acids having the structural formula $R^1COOH$, where $R^1$ is hydrogen, methyl or $CF_3$; diacids having the structural formula HOOC—$(CH_2)_n$—COOH, where n is 0, 1 or 2; and sulfonic acids having the structural formula $RSO_3H$, where R is hydrogen, methyl, ethyl or $CF_3$.

It is emphasized, of course, that in the preferred embodiment wherein a composition is provided the principal constituent of the composition of the present invention is liquid carbon dioxide or supercritical carbon dioxide.

In the event that liquid carbon dioxide is employed, independent of whether it is provided neat or in a composition, it is preferred that the liquid carbon dioxide be present at a temperature of about 5° C. to about 25° C. and at a pressure in the range of between about 100 psi to about 1,000 psi. More preferably, liquid carbon dioxide utilized in the present invention is provided at a temperature in the range of between about 10° C. and about 25° C. and at a pressure in the range of between about 500 psi to about 1,000 psi. Still more preferably, the liquid carbon dioxide is employed in the present invention at a temperature in the range of between about 15° C. and about 25° C. and at a pressure in the range of between about 700 psi and about 900 psi.

The following examples are given to illustrate the scope of the present invention. Because these examples are given for illustrative purposes only, the invention should not be deemed limited thereto.

EXAMPLE 1

A 25 mm diameter polytetraflurorethylene filter having an 0.2 micron pore size was utilized in the filtration of a photoresist composition which comprised a solution of 35% Novolak in propylene glycol methylether acetate (PGMEA). The filter was employed until the flow rate through it was reduced to 0.14 g/sec. At that point the filter was deemed plugged. Thereupon the filter was cleaned utilizing the apparatus of FIG. 3 by charging a supercritical carbon dioxide composition which included 2% by weight tetrahydrofuran. The supercritical carbon dioxide composition flowed through the filter in chamber 40 for 15 minutes during which time the chamber was maintained at thermodynamic conditions which support carbon dioxide in supercritical fluid condition.

The thus cleaned filter was put back in the filter unit and additional photoresist resin was passed through it for filtration. The initial rate of flow through the filter after cleaning was 0.79 g/sec, indicative of the successful unclogging filter during the cleaning operation.

EXAMPLE 2

Filter paper (0.16 g) was contaminated with 5W-30 motor oil (0.03 g) and folded in a coiled configuration to simulate a car oil filter or assembly. The paper was placed in a 50 ml reactor maintained at 45° C. and 3,000 psi. Thereupon supercritical carbon dioxide was introduced into the chamber. After 30 minutes the reactor was opened to the atmosphere and the sample reweighed. The reweighed filter was 0.16 g indicative of the removal of all the oil from the oil-soaked filter.

The above embodiments and examples are given to illustrate the scope and spirit of the present invention. These embodiments and examples will make apparent, to those skilled in the art, other embodiments and examples. These other embodiments and examples are within the contemplation of the present invention. Therefore, the present invention should be limited only by the appended claims.

What is claimed is:

1. An apparatus for cleaning filters comprising a chamber capable of being maintained at thermodynamic conditions consistent with the maintenance of carbon dioxide as a liquid or supercritical fluid, said chamber provided with means for holding a filter, whose pores are plugged, wherein said filter is sealed against the top and bottom of said chamber; a source of a fluid selected from the group consisting of liquid carbon dioxide and supercritical carbon dioxide in communication with said chamber; and means for depressurizing said fluid downstream of said chamber.

2. An apparatus in accordance with claim 1 wherein said carbon dioxide is maintained as a supercritical fluid.

3. An apparatus in accordance with claim 2 wherein said supercritical carbon dioxide is provided in a composition which further includes a surfactant, said surfactant selected from the group consisting of polyethers, siloxanes, fluoroalkanes and mixtures thereof.

4. An apparatus in accordance with claim 3 wherein said composition further includes a co-solvent selected from the group consisting of a diacid having the structural formula HOOC—$(CH_2)_n$—COOH, where n is 0, 1 or 2; a sulfonic acid having the structural formula $RSO_3H$, where R is hydrogen, methyl, ethyl or $CF_3$; a carboxylic acid having the structural formula $R^1COOH$, where $R^1$ is hydrogen, $CF_3$, $C_2F_5$, methyl, ethyl or propyl; triethanolamine; an alcohol having the structural formula $R^2OH$, where $R^2$ is methyl, ethyl or isopropyl; methylethyl ketone; acetone; N-methyl pyrrolidone; α-butylolactone; dimethyl sulfoxide; tetrahydrofuran and mixtures thereof.

* * * * *